United States Patent [19]

Jakobson

[11] 4,278,534

[45] Jul. 14, 1981

[54] METHOD FOR SEPARATION OF MATERIAL MIXTURES, CONTAINING ABRASIVE PARTICLES, IN A HYDROCYCLONE SEPARATOR

[75] Inventor: Karl F. O. Jakobson, Täby, Sweden

[73] Assignee: AB Celleco, Stockholm, Sweden

[21] Appl. No.: 95,064

[22] Filed: Nov. 16, 1979

[30] Foreign Application Priority Data

Nov. 16, 1978 [SE] Sweden ..... 7811825

[51] Int. Cl.[3] ..... B04C 5/085

[52] U.S. Cl. ..... 209/211; 210/512.1

[58] Field of Search ..... 209/144, 211, 11; 210/512 R, 84; 55/435, 394

[56] References Cited

U.S. PATENT DOCUMENTS 2,860,776 11/1958 Hays ..... 209/144 X

FOREIGN PATENT DOCUMENTS 1093751 12/1960 Fed. Rep. of Germany ..... 209/144

2903036 8/1979 Fed. Rep. of Germany ..... 209/211

*Primary Examiner*—Ralph J. Hill

*Attorney, Agent, or Firm*—Cyrus S. Hapgood

[57] ABSTRACT

A method is disclosed, intended for usage with double-mantled hydrocyclone separators of the type which is preferably used in the pulp and paper industry for purification of cellulose fiber suspensions, containing abrasive particles, which may, in the long run, cut a hole in the conical part of the hydrocyclone separator. According to the method, the operation of the hydrocyclone separators is continued also after the moment, when a hole has been formed in the conical part of the hydrocyclone separators. It has become apparent, that no deterioration of the separation ability is observed.

3 Claims, 2 Drawing Figures

Figure 1:
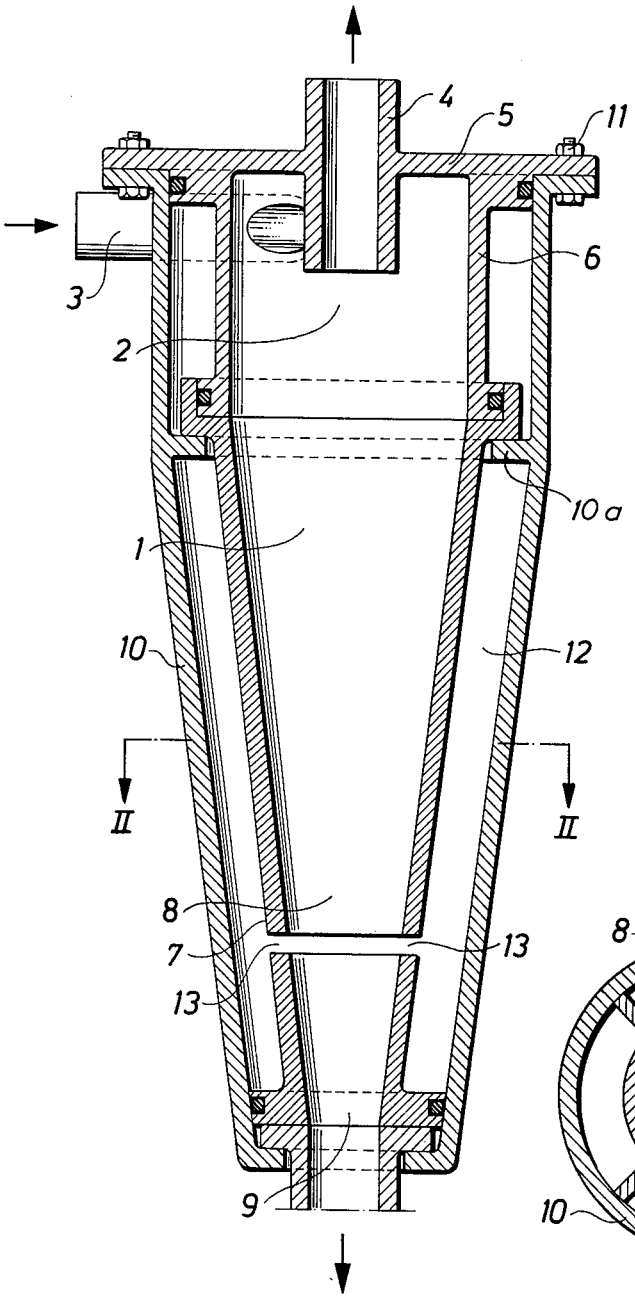

METHOD FOR SEPARATION OF MATERIAL MIXTURES, CONTAINING ABRASIVE PARTICLES, IN A HYDROCYCLONE SEPARATOR

This invention relates to a method for separation of material mixtures, containing abrasive particles, into two fractions by means of a hydrocyclone separator, comprising a separation chamber including partly one circular cylindrical part, provided with at least one tangential inlet for the material mixture fed, and a central first outlet for one of the fractions, and partly one conical part, defining a second outlet for the second fraction, at least the conical part being surrounded, along the total circumference by an outer mantle, in such a way, that a closed chamber is provided, at least between the conical part and said outer mantle.

Hydrocyclone separators have many uses, especially in the cellulose industry for the purification of cellulose fibre suspensions. The impurities consist substantially of sand, bark particles and incompletely digested fibres. These impurities, especially sand particles, act abrasively on the wall of the hydrocyclone, especially in the lower part of the separation chamber, where the particles can make grooves in planes perpendicular to the symmetry axis of the hydrocyclone. Such grooves may, after a more or less long period of operation time be deepened, actually to cut off the hydrocyclone separator. In the pulp and paper industry the process temperatures have increased in modern plants. The reason for this fact is, partly, that new processes have been introduced, and partly that processes, already in use, have been carried out in a more "closed" form, which means that process water is recirculated to a higher extent than previously. In this way considerable savings have been obtained as to fibres and chemicals and energy. The environmental problems have also diminished.

The higher process temperatures have, however, resulted in problems as to the hydrocyclone separators in the plants, as to an increased leakage risk. Considering the hundreds of hydrocyclone separators that are usually comprised in plants in the pulp and paper industry, this means a serious problem, both from a security and an economical point of view. Uncontrolled leakage of a liquid with a temperature of 80°–90° C. can bring about burns on the operators. Any such leakage means that the operation must be disrupted and that the damaged apparatus must be replaced by new equipment. Such an operation stop, that is not planned, is extremely costly in said industry.

The problem concerning abrasion in hydrocyclone separators, especially in their lower, conical part, has been known for a long time. It has been suggested, that hydrocyclone separators are provided with a double mantle at the conical part of the separation chamber by providing the hydrocyclone separator with a replaceable conical part, arranged within an inner mantle in such a way, that a closed chamber is created between said outer mantle and the conical part. Reference is made, for example, to the British Pat. No. 769,906. In this Specification it is provided, however, that the conical part, which can be manufactured in one piece from one material, that is especially wear resistant, is replaced after a certain time of operation, i.e. before it has been cut off by wear.

This invention aims at providing a method of the art mentioned by way of introduction, which is simple and admits a long period of operation, before the conical part of the separation chamber has to be replaced.

Such a method is characterized, surprisingly simply, in that the separation of the material mixture fed is continued also after the moment, when said abrasive particles have cut the conical part, forming an open hole, connecting the conical part of the separation chamber with said closed chamber.

It has become apparent, that it is possible to continue, without deterioration of the function, the operation of such a double-mantled hydrocyclone separator during a considerable period of time after the moment, when abrasive particles have cut the conical part of the separation chamber. As this is surrounded by a closed chamber, limited by an outer mantle, the material mixture within the conical part cannot be discharged from the hydrocyclone separator through the open hole but only to said closed chamber. The closed chamber, filled with liquid, will form a "hydraulic mantle", which admits continued operation without deterioration of the separation ability.

In one preferred embodiment of the method according to the invention, the material mixture, that is discharged to the closed chamber, is prevented from rotating in same by axially oriented baffles, provided in the closed chamber, preferably extending radially from the outer mantle to the wall of the conical part.

Figure 2:
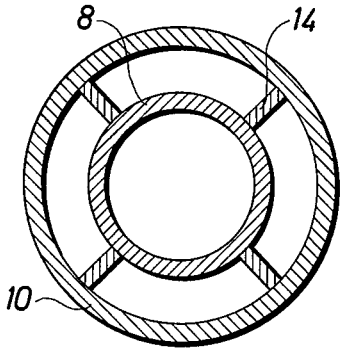

The invention shall now be described more in detail, reference being made to the enclosed drawings, of which FIG. 1 shows a longitudinal sectional view through a device for performing the method and;

FIG. 2 shows a transversal sectional view along line II—II in FIG. 1.

As is apparent from FIG. 1, the hydrocyclone separator disclosed comprises a separation chamber, including partly one circular cylindrical part 2, provided with one tangential inlet 3 and a central outlet 4, provided in a plane cap 5, which extends beyond the wall 6 of the circular cylindrical part, and partly of a conical part 7, with a wall 8, defining a second outlet 9. The separation chamber 1 is surrounded by an outer mantle 10, extending from and tightly surrounding outlet 9, to cap 5, with which it is kept together by bolts 11. Between the wall 8 of the conical part and the outer mantle 10 a closed chamber 12 is formed. In the conical part 7 there is shown a ringformed slot 13, which has been formed by wear of hard particles, which are not shown. Between the outer mantle 10 and the outer side of the conical part 7 axially oriented baffles extend, which are shown in FIG. 2.

When performing the method according to the invention, thus a mixture is fed through inlet 3, is separated in the separation chamber 1 into two fractions, of which one, the so called "accept" is discharged through central outlet 4, whilst the other, the so called "reject" is discharged through the other outlet 9. The mixture presumably contains hard, abrasive particles, which act abrasively on the inner wall of the conical part 7, in such a way, that, in the present case, a slot 13 has been formed in the conical part. The mixture is discharged to the chamber 12 and fills this, whereby pressure equalization between separation chamber 1 and chamber 10 is provided. Thus the separation operation may continue during a considerable period of time, i.e. till the inner wall of the conical part 7 is worn to such an extent, that the function is deteriorated. In the embodiment disclosed, the mixture is prevented from rotating in the closed chamber 10 by the axial baffles 14, which also support the wall 8 of the conical part, especially if this would be cut in more planes.

I claim:

1. In the separation of an abrasive-containing mixture into two fractions by means of a hydrocyclone separator forming a separating chamber including a circular cylindrical part having a tangential inlet for said mixture and a central first outlet for one of said fractions, the separating chamber also including a conical part within a conical wall defining a second outlet for the other of said fractions, there being an outer mantle completely surrounding said conical wall and forming therewith a closed space between said wall and mantle, and method which comprises feeding said mixture through the tangential inlet into the separating chamber to effect said separation, causing said abrasive to form a hole through said conical wall, whereby said conical part of the separating chamber communicates with said closed space through said hole, allowing a mixture from said separating chamber to fill said closed spaced through said hole, and continuing to effect said separation while said hole is present in said conical wall and while said closed chamber remains filled with said mixture.

2. The method of claim 1, which comprises also causing mixture entering said closed space through said hole to impinge against baffle means to resist rotation of the mixture in said space.

3. The method of claim 1, which comprises also retaining in said closed space all of said mixture filling the same during said continuing of the separation.

* * * * *